United States Patent [19]

Baus

[11] 4,301,094

[45] Nov. 17, 1981

[54] EVAPORATION AIR HUMIDIFIER

[76] Inventor: Heinz G. Baus, Ulmenweg 46, CH-3601 Thun, Switzerland

[21] Appl. No.: 68,551

[22] Filed: Aug. 22, 1979

[30] Foreign Application Priority Data

Aug. 24, 1978 [DE] Fed. Rep. of Germany ..... 2836932

[51] Int. Cl.[3] ..... F24F 6/04

[52] U.S. Cl. ..... 261/29; 261/102; 261/103; 261/96

[58] Field of Search ..... 261/29, 94–97, 261/100–103, 105, 106, DIG. 4, DIG. 15; 62/310, 314, 315; 285/9 M, 24, 27, DIG. 22; 222/385, 383; 98/30; 220/353

[56] References Cited

U.S. PATENT DOCUMENTS

| | | | |
|---|---|---|---|
| 3,581,767 | 6/1971 | Jackson | 222/385 |
| 3,784,235 | 1/1974 | Kessler et al. | 285/DIG. 22 |
| 3,914,349 | 10/1975 | Stipanuk | 261/29 |
| 4,026,971 | 5/1977 | Glasoe | 261/29 |
| 4,029,723 | 6/1977 | Morrison et al. | 261/29 |
| 4,049,295 | 9/1977 | Piers | 285/9 M |
| 4,139,222 | 2/1979 | Loland | 285/27 |
| 4,161,248 | 7/1979 | Kalmanovitch | 220/353 |

FOREIGN PATENT DOCUMENTS 2360490 6/1975 Fed. Rep. of Germany ..... 261/29

OTHER PUBLICATIONS

German Petty Patents DE-GM 1,893,690, Apr. 1964; DE-GM 7,529,208, Apr. 1977.

*Primary Examiner*—Gregory N. Clements
*Attorney, Agent, or Firm*—Herbert L. Lerner

[57] ABSTRACT

Evaporation air humidifier having a water supply container with a filter support plate carrying an evaporation filter, and having a removable auxiliary plate whereon electrical components are assembled including a motor and a pump driven thereby and extending into the water supply container, as well as a fan blade disposed on an upper side of the motor, and an installation housing, and further having a connecting hose interconnecting the pump and the evaporation filter and a dome with air inlet and outlet openings including a guide member carried by the auxiliary plate at the underside thereof, a guide secured to the water supply container and engageable with the guide member, a first coupling member for the connecting hose carried by the auxiliary plate, a second coupling member held by the filter support plate, the first coupling member being automatically couplable with the second coupling member when the guide member and the guide are mutually engaged.

9 Claims, 8 Drawing Figures

EVAPORATION AIR HUMIDIFIER

The invention relates to an evaporation air humidifier and, more particularly, to such a humidifier having a water supply container with a filter support plate carrying an evaporation filter, and having a removable auxiliary plate whereon electrical components are assembled including a motor and a pump driven thereby and extending into the water supply container, as well as a fan blade disposed on an upper side of the motor, and an installation housing, and further having a connecting hose interconnecting the pump and the evaporation filter and a dome with air inlet and outlet openings.

In such a heretofore known type of evaporation air humidifier, the filter support plate is formed with an opening which is surrounded by a wall oriented perpendicularly to the plane of the plate, the wall, on its part, having a circular flange on the face thereof enclosing an opening that is somewhat smaller than the opening formed in the filter support plate (German Petty Patent DE-GM No. 75 29 208). The auxiliary plate carrying all the electrical components is placed upon a circular shoulder of this flange, on one side thereof yet slid under the flange. The auxiliary plate carries a latching or locking member with an axis extending perpendicularly to the plane of the plate and which carries a latch at the bottom thereof and a grip or handle at the top thereof. The latch is turned to latch or lock beneath the flange of the filter support plate. If one wishes to remove the auxiliary plate with the electric components, in the case of the abovementioned heretofore known humidifier of this general type, the locking or latching thereof with respect to the filter support plate must be released manually. Likewise, the connecting hose from the pump to the evaporation filter must be manually released at least at one of the connecting locations thereof.

This difficulty exists also in the case of an additional heretofore known evaporation air humidifier with a separated auxiliary plate for all electrical parts laterally inserted into the dome (German Petty Patent DE-GM No. 18 93 690).

It is accordingly an object of the invention to provide an evaporation air humidifier improved over the type generally described in the introduction hereto wherein the removal and insertion of the auxiliary plate is greatly facilitated.

With the foregoing and other objects in view, there is provided in accordance with the invention, an evaporation air humidifier having a water supply container with a filter support plate carrying an evaporation filter, and having a removable auxiliary plate whereon electrical components are assembled including a motor and a pump driven thereby and extending into the water supply container, as well as a fan blade disposed on an upper side of the motor, and an installation housing, and further having a connecting hose interconnecting the pump and the evaporation filter and a dome with air inlet and outlet openings comprising a guide member carried by the auxiliary plate at the underside thereof, a guide secured to the water supply container and engageable with the guide member, a first coupling member for the connecting hose carried by the auxiliary plate, a second coupling member held by the filter support plate, the first coupling member being automatically couplable with the second coupling member when the guide member and the guide are mutually engaged.

In contrast to the heretofore known evaporation air humidifiers described hereinbefore, the auxiliary plate carrying all of the electric components can be removed through the corresponding opening formed in the filter support plate without having to effect an additional manual unlatching or unlocking of the auxiliary plate from the filter support plate. When the auxiliary plate is inserted into the humidifier, a coupling of the coupling members of the connecting hose is automatically effected due to the guidance between the guide member and the guide secured to the water supply container. An added advantage is that the re-connection of the connecting hose can therefore not be forgotten.

In accordance with another feature of the invention, stop means are provided for limiting advancement of the guide and the guide member relative to one another when mutually engaged. Advantageously, a predetermined and stable positioning of the auxiliary plate is thereby attained.

In accordance with a further feature of the invention, the guide comprises a guide bushing, and the guide member is insertable into the guide bushing.

In accordance with an added feature of the invention, the guide bushing is secured or fastened to the bottom of the water supply container. This construction is capable of being effected advantageously integrally with the water supply container with the use of synthetic or plastic material.

In accordance with an additional feature of the invention, the guide member is formed with a shoulder seatable on a free edge of the guide bushing and serving as means for stopping advancement of the guide into the guide bushing.

In accordance with an alternative feature of the invention, the guide member is shorter than the height or length of the guide bushing extending upwardly from the bottom of the water supply container, and the underside of the auxiliary plate comprises stop means for limiting advancement of the guide member in the guide bushing.

Both of the last mentioned variants have an advantage over the prior art humidifier described at the introduction hereto, in that the weight of the electric components need not be absorbed by the filter support plate, but rather, the bracing or support thereof is effected through the guide bushing on the bottom of the water supply container i.e. the filter support plate carries, in fact, only the filter and possibly also a water level indicator. With considerably simplified handling or operation, a higher stability is consequently attained because, during operation with a fan and a pump, vibrations or oscillations are forcibly transmitted to the auxiliary plate, which offers no problem with a separated bracing or support thereof.

In accordance with yet another feature of the invention, the guide member and the guide bushing are in friction-locking engagement. The cross section of the guide member and the guide bushing are, in this case, matched to one another with narrow tolerance.

This plug-type connection has not only advantages with respect to manufacturing techniques, but also, represents the best protection against shifting of the auxiliary plate in the plane of the plate, due to the surface contacts or engagement.

In accordance with concomitant and alternative features of the invention, the guide member and the guide are mutually connected by a snap-in connection comprising means defining a groove in one of either the guide member or the guide and a projection formed on the other of the guide member or the guide and snappable into the groove; or magnetic means are provided for connecting the guide member and the guide to one another.

Other features which are considered as characteristic for the invention are set forth in the appended claims.

Although the invention is illustrated and described herein as embodied in evaporation air humidifier, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figure 1:
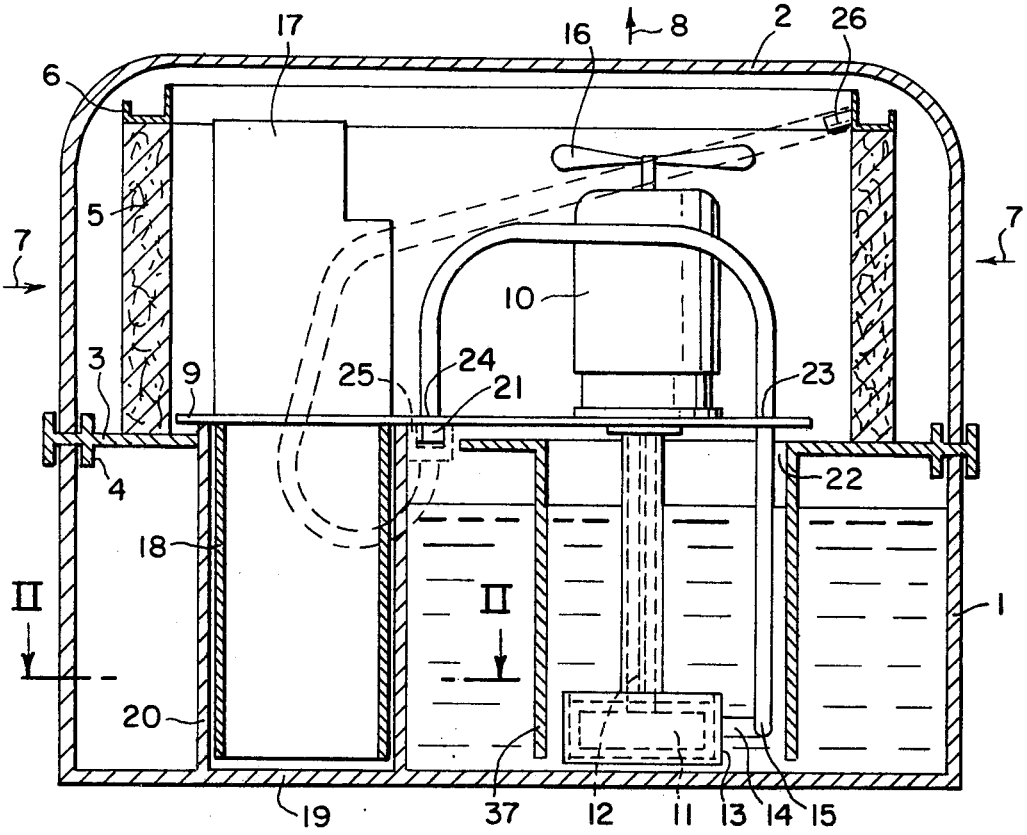
FIG. 1 is a diagrammatic vertical sectional view of the evaporation air humidifier constructed in accordance with the invention, the bottom of the humidifier being at the right-hand side of the figure.

Referring now to the drawing and first, particularly, to FIG. 1 thereof, there is shown an evaporation air humidifier according to the invention having a somewhat elongated box-like outer housing. The cross-sectional view of FIG. 1 is taken parallel to the broad sides thereof. The outer housing shown is made up of a subdivision in the form of a water supply container 1 and a dome 2. A filter support plate 3 is located between the water supply container 1 and the dome 2. In the illustrated embodiment of FIG. 1, the filter support plate 3 has a circular edge portion 4 of H-shaped cross section. An upper edge or rim of the water supply vessel 1, on the one hand, and a lower edge of the dome 2, on the other hand, engage in the edge portion 4 of the filter support plate 3 as shown in FIG. 1, thereby providing a tight closure against the outside. An evaporation filter 5 with a liquid distributor duct 6 is fastened to the filter support plate 3.

To explain the operation of the evaporation air humidifier of the invention, there is indicated by arrows 7 that air is admitted through lateral inlet openings formed in the dome 2 and, after flowing through the evaporation filter 5, discharges together with evaporated water in direction of an arrow 8 through suitable air outlet openings formed in the upper side of the dome 2.

All electrical components of the air humidifier of the invention, namely a motor 10 with a pump 11 and a corresponding pump housing extending into the water supply container 1 are mounted or assembled on an auxiliary plate 9. The motor 10 has a shaft 12 represented diagrammatically by a straight line, which drives a non-illustrated pump wheel in a suitable circular lower casing part 13. A suitable connector 14 for a connecting hose 15 is provided on the lower casing part 13. A blower or fan 16 is seated on the upper side of the shaft 12 (shown at the left-hand side in FIG. 1) which serves to guide the air in the aforedescribed directions indicated by the arrows 7 and 8.

The auxiliary plate 9 furthermore carries an installation housing 17 for additional electrical components, such as a switch for the evaporation air humidifier of the invention and, on the underside thereof, a guide member 18 inserted into a guide bushing 20 integral with the water supply container 1 and secured to the bottom 19 thereof. A coupling member 21 for the connecting hose 15 is fastened to the underside of the auxiliary plate 9. The connecting hose 15 extends from the connector 14 thereof on the casing part 13 through an opening 22 formed in the filter support plate 3, through a first opening 23 formed in the auxiliary plate 9, then above and across the auxiliary plate 9 and, finally, through a second opening 24 formed in the auxiliary plate 9 to the coupling member 21 below the auxiliary plate 9. A second coupling member 25 is connected to the aforementioned coupling member 21 from which the connecting hose 15 extends further to a connecting location 26 on the liquid distributor duct 6.

It is furthermore apparent from FIG. 1 that the guide member 18 is somewhat shorter in length than the height of the guide bushing 20, both as viewed between the left-hand and right-hand sides thereof in FIG. 1. Thus, the underside of the auxiliary plate 9 lies upon the guide bushing 20 extending somewhat out of the filter support plate 3, so that the auxiliary plate 9 together with the electric components carried thereby is supported by the guide bushing 20 on the bottom 19 of the water supply container 1.

The pump 11 is surrounded by a wall 37 extending downwardly from the filter support plate 3 and defining the opening 22 formed in the support plate 3. The opening 22 simultaneously serves as a return opening for excess water. The wall 37 may have a funnel-like shape to prevent splashing of the water in free fall.

To be able to introduce a greater quantity of water into the water supply container 1, the guide bushing 20 can also be broken through so that the inner space thereof is likewise filled with water up to the level thereof in the water supply container 1 at the right-hand side of FIG. 1.

Figure 2:
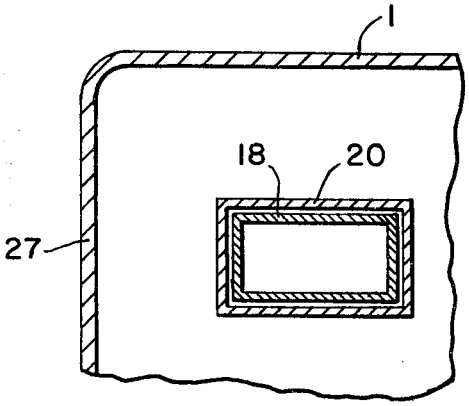
FIG. 2 is a fragmentary cross-sectional view of FIG. 1 taken along the line II—II in direction of the arrows.

From FIG. 2, it is apparent that the guide member 18 and the guide bushing 20 have a rectangular cross section. It is indicated by broken lines in FIG. 2 that the guide bushing 20 can also extend to the left-hand wall 27 of the water supply container 1, as viewed from the right-hand side of FIG. 2 which is upwardly in the usual position of the air humidifier. In this case, a wall of the guide member 18 engages the wall 27, which is elongated, or the wall 27 per se forms one of the walls of the guide bushing 20.

Figure 3:
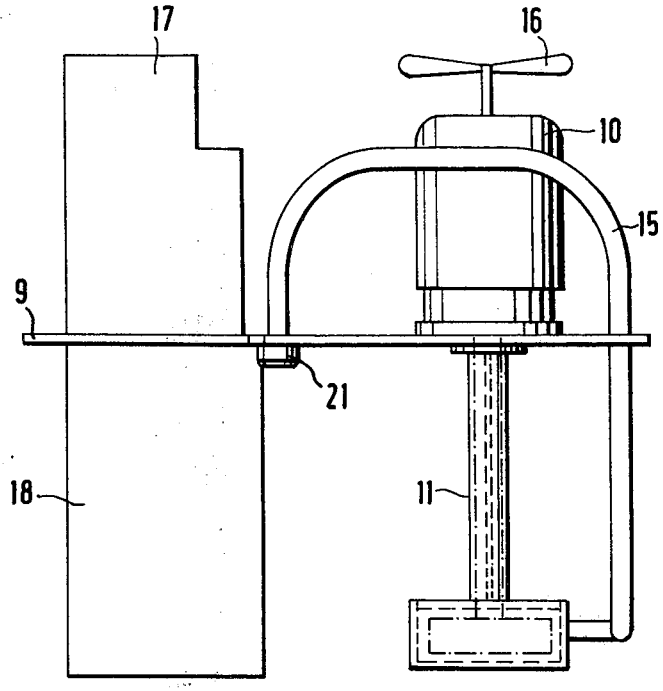
FIG. 3 is a fragmentary elevational view of FIG. 1 rotated clockwise through 90° and showing an auxiliary plate with electrical components removed from the rest of the evaporation air humidifier.

FIG. 3 shows the auxiliary plate 9 with the motor 10, the pump 11, the installation housing 17, the guide member 18 and the part of the connecting hose 15 terminating at the first coupling member 21, which have been removed as a whole from the evaporation air humidifier as illustrated in FIG. 1.

Figure 4:
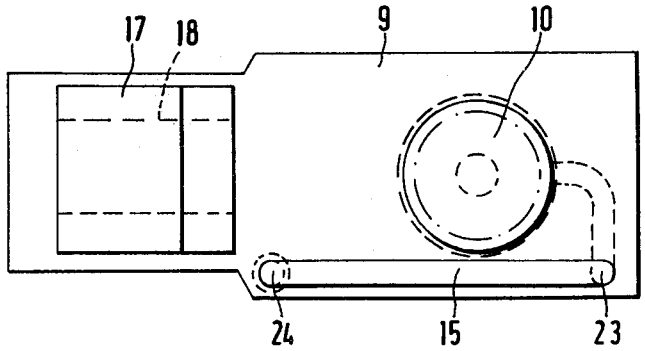
FIG. 4 is a top plan view of FIG. 3.

From the top plan view of FIG. 4, it is apparent that the second opening 24 for the connecting hose 15 is located in a somewhat wider part of the auxiliary plate 9 shown at the right-hand side of FIG. 4.

Figure 5:
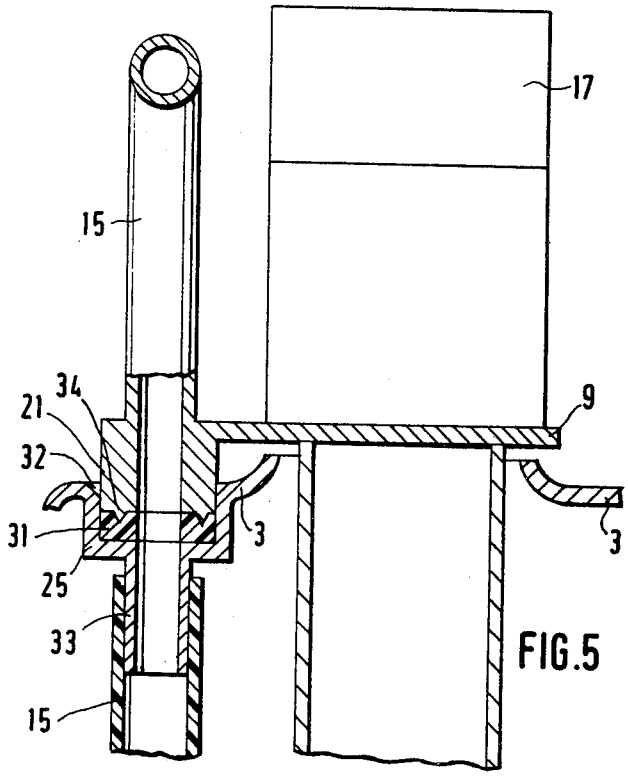
FIG. 5 is an enlarged fragmentary view, partly in section, of FIG. 1.

It is evident from FIG. 5 that the first coupling member 21 at the underside of the auxiliary plate 9 is pressed at the lower side thereof into a soft elastic sealing ring 31. The latter is disposed in the second coupling member 25 which is formed as a pot or cup which is sunk into the filter support plate 3. The second coupling member 25 has a slightly conical lead-in or insert opening 32 so that the first coupling member 21 can be readily introduced and ultimately centered within the pot or cup of the second coupling member 25. The bottom of the cup or pot-like coupling member 25 is formed with an opening to which a connecting piece 33 having a conical or tapering outer surface is connected. The part of the hose 15 shown in broken lines in FIG. 1 is slipped tightly onto the connecting piece 33 so as not to be readily loosened therefrom. An optional annular bead 34 is provided at the underside of the first coupling member 21 and is pressed into the sealing ring 31.

When the guide member 18 is inserted into the guide bushing 20, the first coupling member 21 and the second coupling member 25 become simultaneously connected. The lower side of the auxiliary plate 9 lies upon the upper edge of the guide bushing 20, as shown in FIG. 1, the upper edge of the guide bushing 20 thereby serving as a stop for limiting the depth of insertion of the guide member 18.

Figure 6:
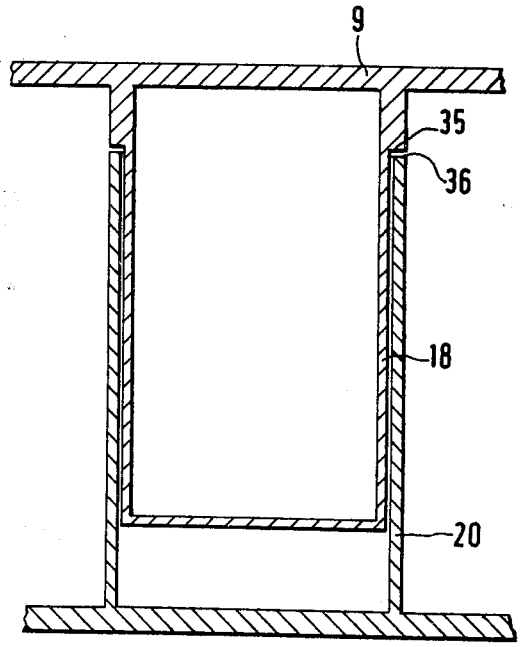
FIG. 6 is a fragmentary view of FIG. 1 rotated clockwise through 90° and showing another embodiment of a stop for a guide of the auxiliary plate.

FIG. 6 shows a construction of the guidance for the auxiliary plate 9 and the equipment carried thereby, which provides an even more advantageous means for limiting the insertion depth of the guide member 18 into the guide bushing 20. To this end, there is provided a stop in the form of a shoulder 35 on the guide member 18 which, in fully inserted position of the guide member 18, is seated upon the upper edge 36 of the guide bushing 20. In contrast to the construction shown in FIG. 1, the guide bushing 20 of FIG. 6 need not be as high.

Figure 7:
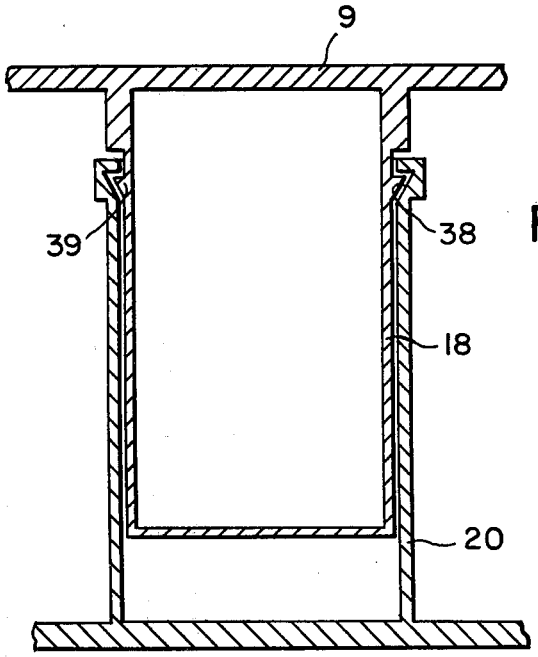
FIGS. 7 and 8 are views corresponding to that of FIG. 6 of other embodiments of the stop for the guide of the auxiliary plate.

In addition to the form-locking plug connection of the guide member 18 and the guide bushing 20 in the embodiments of the invention shown in the figures, additional constructions thereof are possible within the scope of the invention. For example, as shown in FIG. 7, the guide member 18 can carry an outer annular bead 39 which engages or clicks into a corresponding groove 38 formed in the guide bushing 20 or, in the alternative, the guide member 18 may be formed with an outer annular groove into which an inner annular bead on the guide bushing 20 then clicks or engages. For this purpose, the material must be resiliently yieldable.

Figure 8:
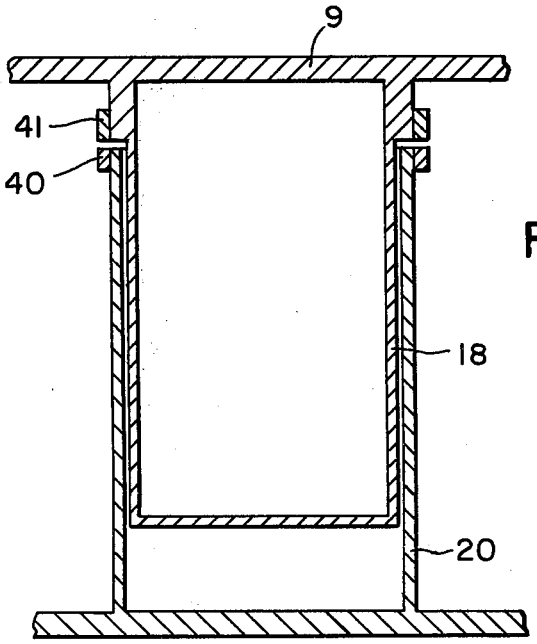

Other guide members may also be provided, as it were, as legs that engage in corresponding guides fastened to the bottom 19 of the water supply container 1. Further possibilities exist, as mentioned hereinbefore, in the application of a magnetic guide as shown in FIG. 8 wherein the guide bushing 20 and the guide member 18 are formed with respective shoulders 40 and 41 of opposite magnetic polarity. In all cases, guidance in vertical direction and a protection against shifting in the plane of the plate must be assured in order to bring the first coupling member 21 and the second coupling member 25 reliably into engagement.

There are claimed:

1. Evaporation air humidifier having a water supply container with a filter support plate carrying an evaporation filter, and having a removable auxiliary plate whereon electrical components are assembled including a motor and a pump driven thereby and extending into the water supply container, as well as a fan blade disposed on an upper side of the motor, and an installation housing, and further having a connecting hose interconnecting the pump and the evaporation filter and a dome with air inlet and outlet openings, the air humidifier comprising a guide member carried by the auxiliary plate at the underside thereof, a guide secured to the water supply container and engageable with said guide member, a first coupling member for the connecting hose carried by the auxiliary plate, a second coupling member held by the filter support plate, said first coupling member being automatically couplable with said second coupling member when said guide member and said guide are mutually engaged.

2. Evaporation air humidifier according to claim 1 including stop means for limiting advancement of said guide and said guide member relative to one another when mutually engaged.

3. Evaporation air humidifier according to claim 1 wherein said guide comprises a guide bushing, and said guide member is insertable into said guide bushing.

4. Evaporation air humidifier according to claim 3 wherein said guide member is formed with a shoulder seatable on a free edge of said guide bushing and serving as means for stopping advancement of said guide into said bushing.

5. Evaporation air humidifier according to claim 3 wherein said guide bushing is secured to the bottom of the water supply container.

6. Evaporation air humidifier according to claim 5 wherein said guide member is shorter than the length of said guide bushing extending upwardly from said bottom of the water supply container, and the underside of the auxiliary plate comprises stop means for limiting advancement of said guide member in said guide bushing.

7. Evaporation air humidifier according to claim 3 wherein said guide member and said guide bushing are in friction-locking engagement.

8. Evaporation air humidifier according to claim 1 wherein said guide member and said guide are mutually connected by a snap-in connection comprising means defining a groove in one thereof and a projection formed on the other thereof and snappable into said groove.

9. Evaporation air humidifier according to claim 1 including magnetic means for connecting said guide member and said guide to one another.

* * * * *